United States Patent [19]

Kirby et al.

[11] 3,993,012

[45] Nov. 23, 1976

[54] VESSEL FOR TRANSPORT OF BUOYANT CARGO

[75] Inventors: William Everett Kirby, Victoria, Hong Kong; David Jackson Seymour, Daly City, Calif.

[73] Assignee: Wharton Shipping Corporation, Edificio Vallarino, Panama

[22] Filed: June 3, 1975

[21] Appl. No.: 583,299

[52] U.S. Cl. ..... 114/43.5 VC; 114/198

[51] Int. Cl.[2] ..... B63B 35/42

[58] Field of Search ..... 114/43.5 VC, 45, 47, 114/121, 125, 72, 198

[56] References Cited

UNITED STATES PATENTS

| | | | |
|---|---|---|---|
| 1,533,776 | 4/1925 | Tiburtius | 114/43.5 VC |
| 3,133,518 | 5/1964 | Burnett | 114/45 |
| 3,400,681 | 9/1968 | Clay | 114/43.5 VC |

*Primary Examiner*—Trygve M. Blix
*Assistant Examiner*—Gregory W. O'Connor
*Attorney, Agent, or Firm*—Owen, Wickersham & Erickson

[57] ABSTRACT

A vessel for transport of a floating buoyant cargo such as barges, lighters, and pontoons, wherein the cargo is partially supported in the vessel by its own buoyancy. The hull has an imperforate bottom shell with rigid submarine cargo-supporting and hull-reinforcing structure, a bow, a stern, side walls providing a series of buoyancy compartments, and a hollow enclosed interior including a cargo hold. Water can be introduced into or expelled from the buoyancy compartments to adjust the draft, trim, and list of the vessel. The cargo-supporting and hull-reinforcing structure has openings communicating with the hold and providing a bottom chamber that is always flooded during the voyage but can be pumped out for maintenance and repair. A series of water conduits pass to the ocean at intervals along the length of the hold, each conduit being located (when the vessel is level) at all points above the top of the bottom chamber. The conduit preferably has a horizontal inlet portion communicating with the ocean, a horizontal outlet portion communicating with the hold, and a connecting inverted U-shaped portion above and connected to both horizontal portions. A tube extends upwardly from the upper end of each inverted U-shaped portion and has an on-off valve at its upper end, for maintaining or breaking the siphon effect of the conduits.

9 Claims, 3 Drawing Figures

VESSEL FOR TRANSPORT OF BUOYANT CARGO

BACKGROUND OF THE INVENTION

This invention relates to a vessel for transport of a floating buoyant cargo, such as barges, lighters and pontoons.

A previous application, Ser. No. 511,492, now U.S. Pat. No. 3,913,512, Oct. 2, 1974, describes a vessel of this general type, and the present invention may be considered as an improvement over that invention. In that invention, the hold of the vessel is always open to the ocean waters. While such a vessel is quite feasible, the hold can be pumped dry for maintenance and repair work only by first placing the vessel in a dry dock.

The previous application shows a vessel with openings going directly through the bottom shell of the hull, and such openings create hydrodynamic drag which can slow the speed of the vessel on the ocean.

An important purpose of the present invention is to provide a vessel obtaining the desirable features of operation of the preceding invention, wherein advantage is taken of the buoyancy of the cargo to help support the ship, while at the same time making it possible to dry out the hold for, e.g., maintenance, cleaning or painting, when the ship is empty of cargo, without having to place the ship in dry dock.

It is also an object of the present invention to provide for the free exchange of water between the ocean and the hold during the voyage where the cargo is being carried, and also to make it possible to keep the hold readily flooded at all times, except when the vessel is to be pumped dry.

Another object of the invention is to provide a vessel of the type in which the cargo is buoyantly supported during the voyage by ocean water, while at the same time providing an imperforate hull giving a better hydrodynamic surface for movement through the water. In other words, instead of a hull that has openings directly in its bottom shell that tend to create resistance in the water, the present invention is adapted to provide a more usual type of hull while still fully realizing the advantages of the flooded hold.

SUMMARY OF THE INVENTION

The vessel of the present invention is like that of application Ser. No. 511,492, now U.S. Pat. No. 3,913,512, insofar as the cargo is partially supported in the vessel by its own buoyancy and the hold is flooded during the voyage. However, the hull, in this instance, has in imperforate bottom shell designed to give good smooth lines, but again, it has a rigid submarine cargo-supporting and hull-reinforcing structure, as well as a bow, a stern, and side walls that provide a series of buoyancy compartments. The vessel is also provided with gate means that can be opened to enable flotation-loading and unloading of the cargo. It also has securing means for releasably locking the cargo in place in the flooded hull against movement relative to the hull and for holding the cargo there all during the voyage of the vessel. A lower portion of the cargo engages the submarine cargo-supporting structure, and the securing means engages an upper portion of the cargo and holds it down against the cargo-supporting structure. Since the hold is flooded and is in free communication with the ocean during the voyage, the invention is, as described so far, exactly like that of application Ser. No. 511,492, now U.S. Pat. No. 3,913,512, except that the hull bottom is imperforate.

To provide access for water into and out of the hold, the vessel is provided with a novel system including a series of water conduits that pass from the hold to the ocean at intervals along the length of the vessel, and each conduit is so located that in reference to the vessel when it has no trim and is level, all points of the conduit will lie above the top of a bottom chamber that is provided in the hold. This bottom chamber has openings communicating with the hold for free passage of water therethrough. The conduit in each instance has a horizontal inlet portion that communicates directly with the ocean and a horizontal outlet portion that communicates directly with the hold; these two portions are connected together by an inverted U-shaped portion which extends up above the horizontal portions and provides at some times a siphon type of action for transfer of water between the hold and the ocean. The conduits are so located vertically that their inlet portions lie just below the light-draft waterline of the vessel with the hold flooded. The inverted U-shaped portions lie just above the light-draft waterline of the vessel with the hold flooded.

A tube or vent pipe extends upwardly from the upper end of each of the inverted U-shaped portions, and at the top of each tube maybe an on-off valve which is used for maintaining the siphon effect by keeping the valve closed, or for breaking the siphon effect when the valve is open. Each conduit is provided with suitable watertight plates or gate valves for effectively closing tight when it is desired to dry out the hold without having to place the vessel in a dry dock. With the conduits so closed, then a portable pump may be used to pump out the hold. Of course, a permanent pump may be used together with a permanent manifold and piping system of frequency if this operation so demands. For less frequent use, the portable pump arrangement will usually be employed because of lower cost.

Other objects and advantages of the invention and other structural features will appear from a description of a preferred embodiment thereof.

DESCRIPTION OF A PREFERRED EMBODIMENT

Figure 1:
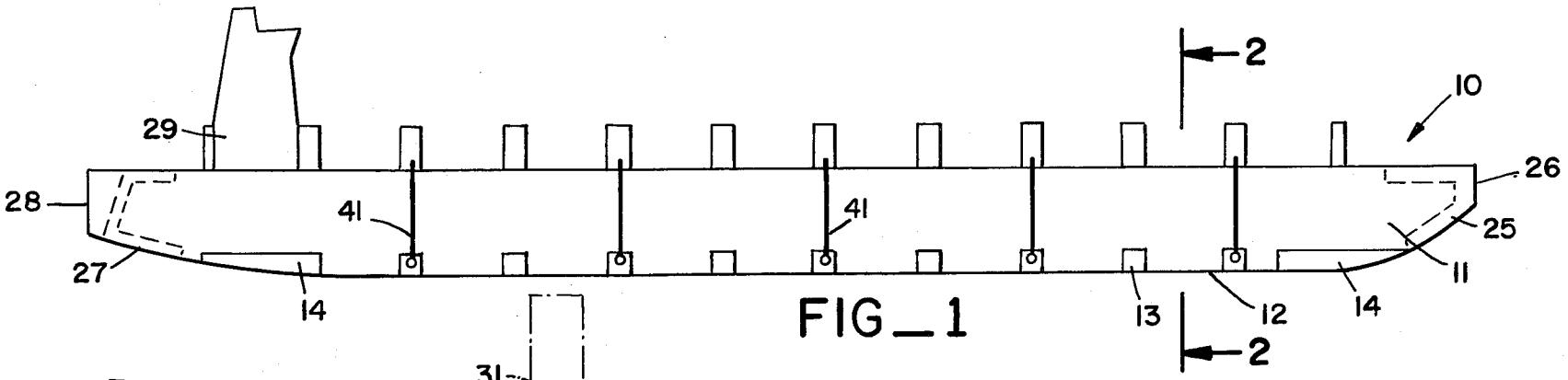
FIG. 1 is a somewhat diagrammatical view in side elevation and in section of a vessel embodying the principles of the invention.
Figure 3:
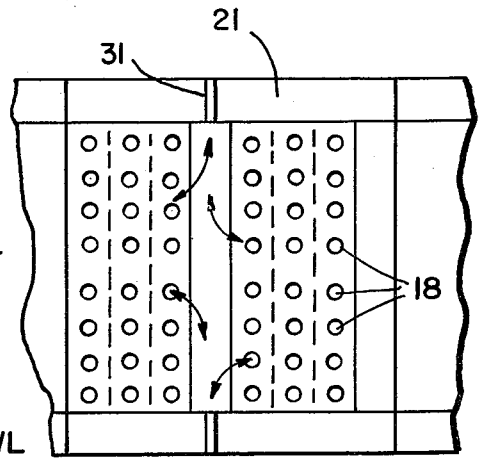
FIG. 3 is a fragmentary view taken along the line 3—3 in FIG. 2.

The invention may be exemplified by a vessel 10 shown in the drawings. The vessel 10 has a hull 11 with an imperforate bottom shell 12. Thus, in this invention, as distinct from application Ser. No. 511,492, now U.S. Pat. No. 3,913,512, the hull bottom 12 is imperforate.

The hull bottom 12 helps support and is strengthened by a rigid submarine cargo-supporting and hull-reinforcing structure, which includes a series of watertight box beams 13 and some larger watertight compartments 14 near each end of the vessel 10. In between these box beams 13 and between them and the watertight compartments 14, and partially supported by them, is a series of plates 15 shown in FIG. 2, which are also supported by vertical web plates 16 that rest on the bottom 12. A series of chambers 17 is provided by these members, the bottom 12, and the box beams 13 and compartments 14. The plates 15 have many openings 18 in them, and the plates 16 have many openings 19 in them, so that, as far as water is concerned, the chambers 17 are in constant communication with the vessel's hold 20.

The hull 11 also has watertight buoyancy compartments 21 in between outside side walls 22 of the hull 11 and inner side walls 23. A deck 24 may serve as the top side of these buoyancy compartments 21.

As shown best in FIG. 1, there may be a swingable or hinged gate 25 at the bow 26 and there may be another gate 27 at the stern 28. Alternatively, there may be only one of these two gates. The purpose of these gates 25 and 27 is to afford entry to floating cargo 30, which may be a series of barges or lighters or pontoons, or other types of containers. Thus, with the hold 20 flooded, as will be described below, these containers 30 can be floated in through an opened gate 25 or 27 and floated out, either through the same gates or the one at the opposite end, if there are two gates. Winches (not shown) may be used for moving the containers 30 inside the hold and for positioning them. The vessel 10 is self-propelled and has its engines and superstructure 29, etc., at the stern end 28.

Barges or other containers 30, once floated into the hold, are positioned and are then held in place by a series of power-activated retractable members or spuds 31. The barges 30 rest on top of the submarine cargo-supporting hull-reinforcing structure 13 and 14 and are held down or locked in position there by these spuds 31, which are preferably hydraulically operated; either the piston or the cylinder moves, while the other one remains in a stationary position. All this is substantially as described in U.S. patent application Ser. No. 511,492.

When all the lighters or barges 30 have been brought inside the hold 20 of the vessel 10, they are roughly positioned with respect thereto. The inside walls 23 of the buoyancy tanks 21 slope downwardly and inwardly, so that the buoyancy tanks 21 are narrower at their upper ends than at their lower ends, and these side walls 23 may carry diagonal fender strips of matting or elastomer which protect the buoyancy tanks 21 from damage from the barges and lighters. The buoyancy tanks may then be deballasted to lighten the vessel so as to lift partially the heaviest laden of the barges or lighters 30 on the box beam 13 of the hull 11. The containers 30 are aligned during deballasting so that they will eventually seat.

Each container 30 has its own waterline and typically, some containers 30 have a higher waterline than others. When floating freely, all containers 30 are buoyant. When secured in place by the buoyancy transfer and securing means described, they all are held at the same level. When the original waterline of a container 30 lies above the waterline at which it is held by the spuds 31, then the net effect is that a portion of the weight of the container, equal to the volume of water displaced between the above-stated waterlines, is supported by the hull 11. Conversely, when the original waterline of a container 30 lies below the waterline at which it is held by the spuds 31, then the effect is to add upward buoyancy to the vessel 10—162 to transfer buoyancy from the container 30 and thus to cause the buoyancy of the container to help buoy up the vessel 10 and help carry the load of the more heavily loaded containers.

The total load of the vessel 10 is lightened by the lighter containers 30, which may be completely empty or may be considerably lighter and thereby, in effect, impart a negative load to the hull 11, counteracting to some extent the positive load of the filled and heavy barges or lighters 30. This transfer of buoyancy enables a sharing which is very effective.

Figure 2:
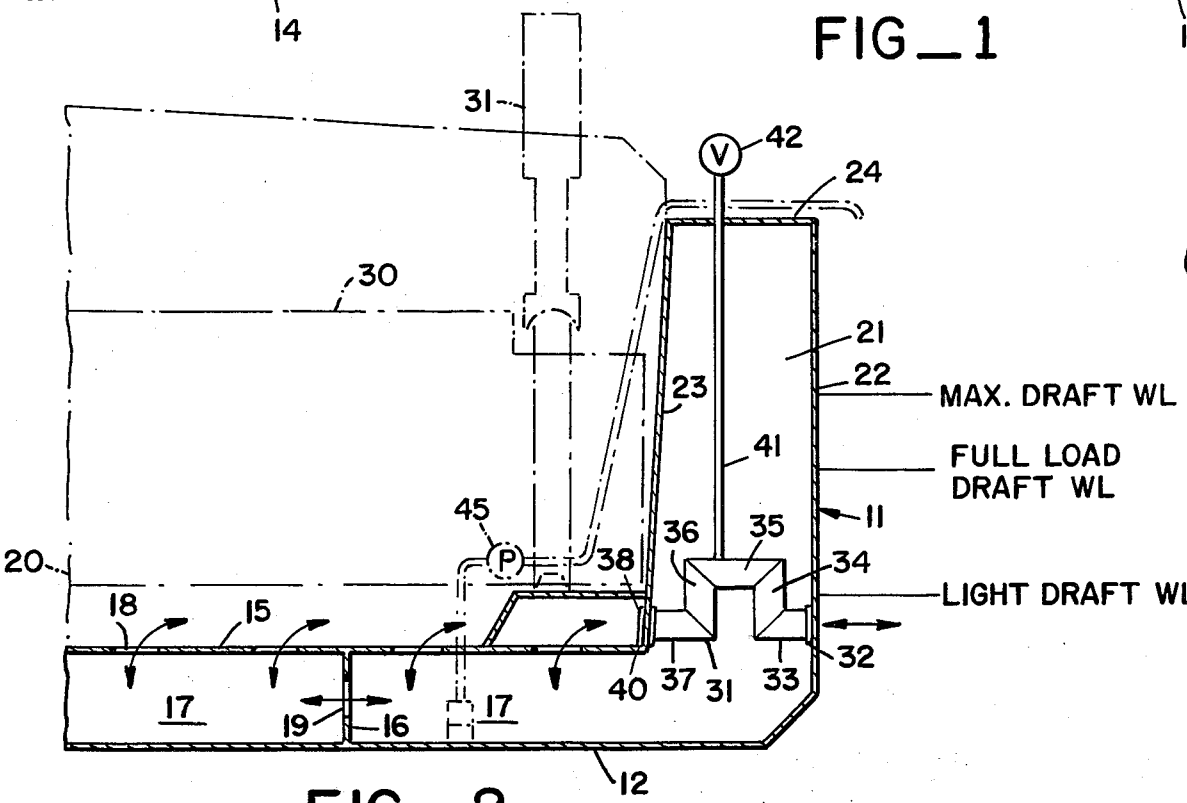
FIG. 2 is an enlarged view taken along the line 2—2 in FIG. 1 but showing only half of the width of the vessel, the other half being a substantial or exact duplicate. Various waterlines are also shown. A buoyant cargo container is shown in broken lines.

The present invention provides for communication between the hold 20 and the ocean through a series of conduits 31 preferably having a structure generally like that illustrated in FIG. 2. Thus, below the light draft waterline of the vessel, there is an inlet opening 32 into a horizontal conduit portion 33. The conduit portion 33 may be connected to an upwardly extending generally vertical conduit 34 which leads by a horizontal conduit portion 35 to another vertically extending conduit portion 36 which goes back to substantially the level of the conduit portion 33 and is connected to another horizontal conduit portion 37 having an outlet 38 into the hold 20. The outlet 38 may be provided with a portable watertight cover plate 40 or a gate valve for positively closing the opening 38 when pumping the hold to dry; normally, the outlet opening 38 is kept open to provide direct communication with the sea through the conduit 36. The conduit portions 34, 35, and 36 constitute a substantially inverted U-shaped conduit portion which extends up from the two horizontal conduit portions 33 and 37. They may be actually in the form of a curved "U", if desired, or in any other form which will accomplish the purpose, which is to provide at times a siphon effect with a portion rising above the light draft waterline but communicating with the horizontal conduit portions 33 and 37, both of which lie below the light draft waterline.

From the upper end of the horizontal portion 35 a tube 41 extends upwardly, preferably to a point above deck where an on-off valve closure 42 is provided. When the valve 42 is closed, as it normally is, then (depending on the height of the vessel's waterline) either a flooding effect or a siphon effect is present and active, and therefore water goes freely between the hold 20 and the ocean, keeping hold 20 flooded to the same level as the ocean outside. The buoyancy chambers 21, during transport, are normally utilized to control the draft of the vessel 10 at or near its full-load draft waterline shown in FIG. 2, and can be utilized to keep the vessel 10 as deep as the maximum draft waterline, when desired. All this is done by operation of the buoyancy chambers 21 either by pumping out water or by admitting air under pressure and forcing out water or to admit water by pumping it in and forcing out air. However, the flooding conduits 31 have no connection with the buoyancy chambers 21 except that they may pass through them. There are preferably conduits 31 on both sides of the hull 11, and preferably, they are spaced at substantially regular intervals throughout. Therefore they keep the hold 20 flooded, the depth of the water depending upon the state of the buoyancy chambers 21. The operation in this particular is substantially the same as that of U.S. patent application Ser. No. 511,492, now U.S. Pat. No. 3,913,512, except that the present invention has the advantage that the hull bottom 12 is imperforate and therefore offers less resistance to water, for the inlets 32 do not offer much water resistance, certainly not as much as openings through the hull bottom. This important advantage is supplemented by the siphon effect which still assures the desired flooding.

The structure of this invention, however, has another advantage, and that is that when the hold 20 of the vessel 10 is flooded, the one in the previous application Ser. No. 511,492, now U.S. Pat. No. 3,913,512, cannot be pumped out except by placing the vessel 10 in a dry dock and draining the hold 20 dry. In the present invention, the use of the dry dock is not necessary for drying out the hold 20. Instead, after deballasting the buoyancy compartments 21 to raise the vessel 10 to its light draft waterline below the top of the raised loop, the on-off valve 42 is opened to break the siphon effect of the water in the conduits 31. With the hold 20 now separated from the ocean by the raised loop of the conduits 31, the plate 41 is secured watertight over each outlet 38. Then a pump 45 having a flexible line 46 is used to pump water out from the hold 20 and also from the chambers 19 common with the hold 20. Then the hold 20 can be serviced inside as desired. When it is desired to flood the hold 20 again, the plate 40 is removed from the outlet 38, the vessel 10 ballasted in the buoyancy compartments 21, and the water from the ocean again floods the hold 20 through the conduits 31.

Although the ocean has been mentioned many times in this specification, it is only an example of the type of body of water in which the vessel may be used. It may, of course, be used in any body of water, including fresh water lakes and rivers, so long as they are otherwise suitable.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. In a vessel for transport of floating buoyant cargo carriers and having a hull with a bottom shell, rigid cargo-supporting and hull-reinforcing structure extending above said shell, side walls extending upwardly from said shell and providing a series of buoyancy compartments, and a cargo hold, means for introducing and expelling water and air into and from said buoyancy compartments, gate means in said hull for enabling flotation loading and unloading in said hold of said floating cargo carriers and for closing during transportation thereof, and securing means for releasably locking said cargo carriers in place in said hold against movement relative to said hull all during a voyage of said vessel, the combination therewith of:

said bottom shell being imperforate, a series of water conduit means in each of said side walls communicating between the ocean and said hold for passing water from the ocean into and out of said hold in accordance with the draft of said vessel and the motion thereof during voyage, each said water conduit means comprising a generally horizontal pipe having an inverted generally U-shaped vertical portion in between a first opening communicating with the ocean and a second opening communicating with said hold and lying no higher on said ship than said first opening, both said openings lying below the light draft waterline of said vessel, and a tube extending upwardly from an apex region of said inverted generally U-shaped portion having valve means at its upper end for closing said tube and for venting it to the atmosphere.

2. The vessel of claim 1 wherein said water conduit means includes gate means for closing the passage of water from the ocean into and out of said hold.

3. The vessel of claim 2 additionally comprising pump means for withdrawing water from said hold when said gate means has closed said conduit means.

4. In a vessel for transport of floating buoyant cargo carriers and having a hull with a bottom shell, rigid cargo-supporting and hull-reinforcing structure extending above said shell, side walls extending upwardly from said shell and providing a series of buoyancy compartments, and a cargo hold, means for introducing and expelling water and air into and from said buoyancy compartments, gate means in said hull for enabling flotation loading and unloading in said hold of said floating cargo carriers and for closing during transportation thereof, and securing means for releasably locking said cargo carriers in place in said hold against movement relative to said hull all during a voyage of said vessel, the combination therewith of:

said bottom shell being imperforate, water conduit means in said side walls communicating between the ocean and said hold for passing water from the ocean into and out of said hold in accordance with the draft of said vessel and the motion thereof during voyage, said water conduit means comprising an inverted generally U-shaped generally vertical portion through which the water from the ocean flows into and out of said hold, and control valve means for communicating between said water conduit means and the atmosphere in a way that prevents said conduit means from siphoning water between the ocean and said hold.

5. The vessel of claim 4 wherein said water conduit means comprises a plurality of said generally U-shaped portions at spaced intervals along the length of said hold.

6. The vessel of claim 5 wherein each said water conduit means comprises a generally horizontal pipe having said inverted U-shaped vertical portion in between two horizontal portions, one portion having an opening communicating with the ocean and the other portion having an opening communicating with said hold, said horizontal portions lying below the light draft waterline of said vessel, and wherein said valve means comprises a tube extending upwardly from an apex region of said inverted U-shaped portion and an on-off valve at the upper end of said tube for opening and closing said tube and venting to the atmosphere.

7. The vessel of claim 6 additionally comprising a normally open gate for closing each said horizontal pipe.

8. The vessel of claim 7 wherein each said normally open gate closes said opening communicating with said hold.

9. In a vessel for transport of floating buoyant cargo carriers and having a hull with a bottom shell, rigid cargo-supporting and hull-reinforcing structure extending above said shell, side walls providing a series of buoyancy compartments, and a cargo hold, means for introducing and expelling water and air into and from said buoyancy compartments, gate means in said hull for enabling flotation loading and unloading in said hold of said floating cargo carriers and for closing during transportation thereof, and securing means for releasably locking said cargo carriers in place in said hold against movement relative to said hull all during a voyage of said vessel, the combination therewith of:

said bottom shell being imperforate, a series of generally horizontal water conduits passing from said hold to the ocean at intervals along the length of said hold, each having an inverted U-shaped vertical portion in between two horizontal portions, each said conduit having an inlet communicating with the ocean and an outlet communicating with said hold, its horizontal portions lying below the light draft waterline of said vessel, a normally open gate for closing each said conduit, a tube extending upwardly from the upper end of each inverted U-shaped portion, and an on-off valve at the upper end of each said tube for opening and closing said tube to the atmosphere.

* * * * *